United States Patent [19]

Franks et al.

[11] 4,029,029

[45] June 14, 1977

[54] METHOD AND APPARATUS FOR TUFTING HIGH AND LOW CUT PILE IN THE SAME ROW

[75] Inventors: Aud J. Franks, Rocky Face; Harold E. Hawkins, Chatsworth, both of Ga.

[73] Assignee: Patrick F. Henry, Sr., Atlanta, Ga.

[22] Filed: July 22, 1974

[21] Appl. No.: 490,763

[52] U.S. Cl. ..... 112/79 R; 112/266; 112/410

[51] Int. Cl.[2] ..... D05C 15/22; D05C 15/32

[58] Field of Search ..... 112/79 R, 79.5, 79 A, 112/79 FF, 266, 263, 410, 411

[56] References Cited

UNITED STATES PATENTS

| | | | |
|---|---|---|---|
| 2,875,714 | 3/1959 | Nix | 112/79 A |
| 2,876,441 | 3/1959 | Boyles | 112/79 A |
| 3,084,645 | 4/1963 | Card | 112/79 R |
| 3,108,553 | 10/1963 | Beasley | 112/79 R |
| 3,108,554 | 10/1963 | Payne et al. | 112/79 R |
| 3,138,126 | 6/1964 | Card | 112/79 R |
| 3,162,155 | 12/1964 | Charles | 112/79 R |
| 3,203,379 | 8/1965 | Dedmon et al. | 112/79 R |
| 3,820,482 | 6/1974 | Woodcock | 112/79 A |

FOREIGN PATENTS OR APPLICATIONS

| | | | |
|---|---|---|---|
| 202,041 | 2/1966 | Sweden | 112/79 R |

*Primary Examiner*—H. Hampton Hunter
*Attorney, Agent, or Firm*—Patrick F. Henry

[57] ABSTRACT

Conventional multi-needle tufting machines may be modified and provided with the special looper element of the present invention so that without backdrawing or robbing from a previous loop a row of stitching is formed to provide a pattern of any number of high cut loops and low cut loops. The looper element is reciprocated by the conventional mechanism and the loops are cut by long and short knives reciprocated by the conventional knifebar on the machine. The looper element may be made from flat plate in one plane to provide a support portion and a closed end, like a nose with an internal space, which enters the loop. A bottom member like a finger on the nose and a top member defines the internal space which is substantially closed by means of the bottom member except for an offset entrance having a small angular configuration. The small angular entrance leads to the space in the looper element in which a short loop supplied by a pattern control means is confined until cut. The long loops slide around the nose and along the bottom member without entering the notch and are cut by a short knife whereas the short loops inside the element are cut by a long knife.

25 Claims, 11 Drawing Figures

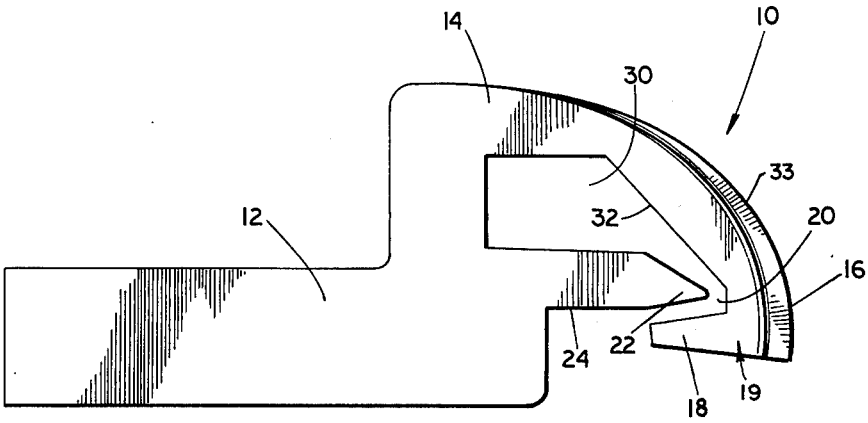
FIG 1
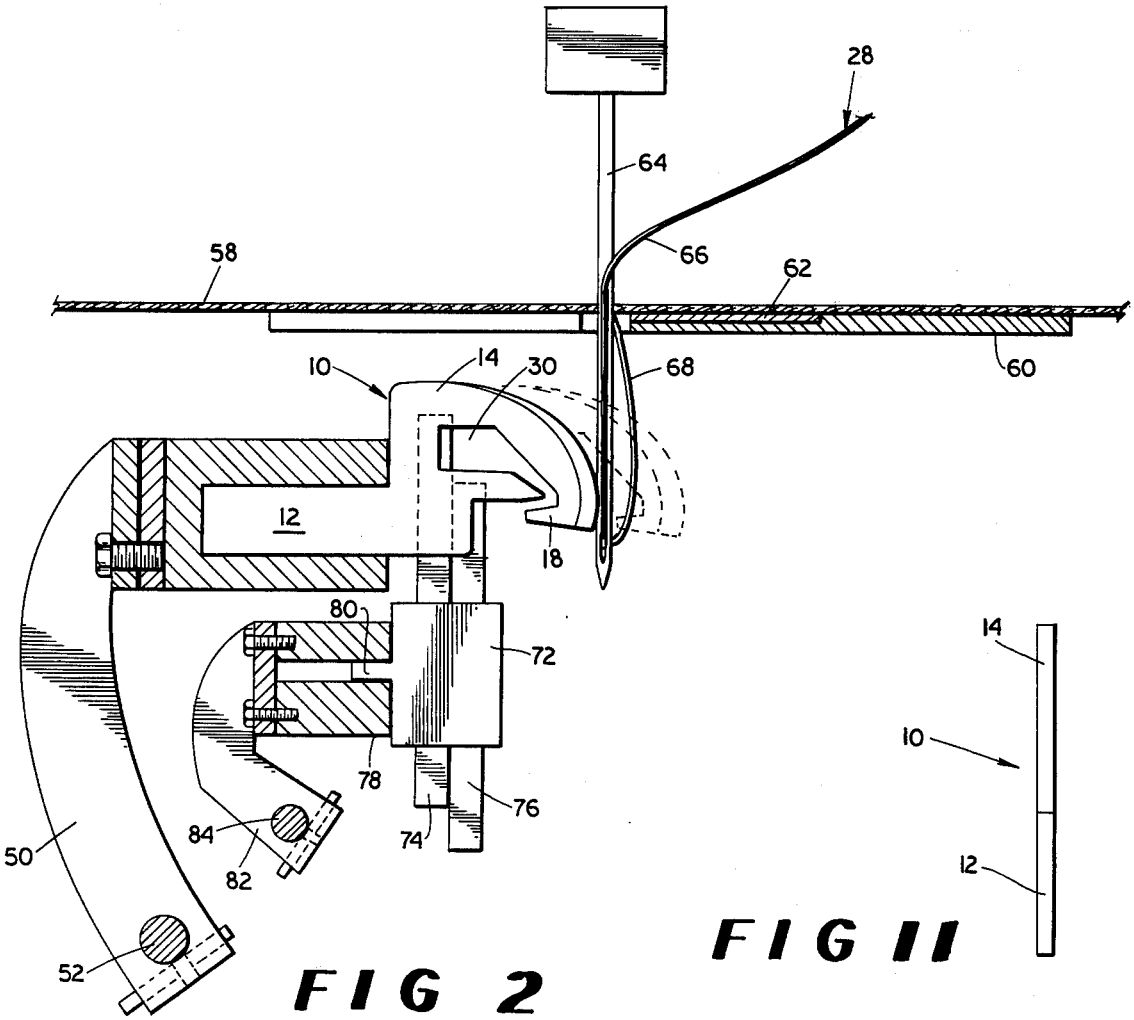
FIG 2
FIG 11

METHOD AND APPARATUS FOR TUFTING HIGH AND LOW CUT PILE IN THE SAME ROW

BACKGROUND OF THE INVENTION

1. Field of the Invention

The field of the invention is multi-needle tufted machines and methods and particularly looper elements which engage the yarn loops on one side of the fabric for the purpose of cutting same into a pile.

2. Description of the Prior Art

The prior art includes several methods of making the cut pile and loop pile including carving or shearing after tufting and perhaps a more common use of a loop engaging member sometimes called a looper in conjunction with a knife which cuts a loop to make a pair of straight pile fibres. It has been possible to tuft a high-low fabric (carpet) where the high fibres were cut from loops but the low fibres were still in the low loop form because of the difficulty in cutting both high or long loops and low or short loops in the same row of stitching. Therefore it is quite common to see carpet which has a high cut pile but low loop mixed in the same row. Some prior art procedures required backdrawing (See Boyles U.S. Pat. No. 2,876,441) in order to make the low pile or loops and therefore make it difficult to cut the low loops. It is desirable to have a pattern which includes both high cut pile and low cut pile in the same row of stitching or in combination of several high cut and several low cut or other combinations thereof and to do this on a conventional machine in a continuous manner. This has not been practical in the art previously because of the limitations mentioned above with respect to the fitting and cutting of both the high loops and the low loops in the same row of stitching and the speed of which the backing material moves and the machine operates. The prior art discloses a number of different loopers (loop engaging fingers or hooks) for use in making a high cut pile. Among the prior art is U.S. Pat. No. 3,084,645 which discloses a hook and cooperating knife arranged to form cut pile together with a means for selectively backdrawing the yarn to pull selected loops off the free end of the hook before they are cut by the knife in order to form loop pile. The short loops are made by tensioning the yarn so that it slips off the hook when the yarn is backdrawn which requires the use of some means to close the free end of the hook to prevent the withdrawal of loops from the hook which in the patent is in the form of a yieldable spring. The present arrangement not only provides a method for making both high cut pile and low cut pile off the same looper, but does so without the use of springs or other movable or yieldable parts since the looper element of the present device is one rigid structure.

SUMMARY OF THE INVENTION

An object of this invention is to provide a method in a needle tufting machine of high cut pile and low cut pile from the same needle and moving element.

Another object of the present invention resides in the objectives stated in the previous paragraph plus performing this method without springs or movable portions of the looper element and without any other auxiliary devices to assist the looper element.

Still another object of the present invention resides in the previously recited objectives together with accomplishing the method through the use of conventional patterning control means and without extensive modification of existing tufting machines through only the substitution and employment of a different looper element properly aligned and placed on the looper bar and the use of a double-knife arrangement which is properly aligned on the existing knifebar thereby drifting looper drive and bar and existing knife drive and bar.

The present looper element may be made substantially in one plane from a small plate and the parts machined into said plate thereby eliminating any fitting and assembly.

Other and further objects and advantages of the present invention will become apparent upon reading the following specification taken in conjunction with the accompanying drawings.

BRIEF DESCRIPTION OF THE DRAWINGS

FIG. 1 is a side elevation view of the looper element of the present invention.

FIG. 2 is a side elevation view of the first of a series of sequential diagrams showing the movement of the looper element in conjunction with the needle on conventional tufting machines.

FIG. 11 is a left end elevation view of the device in FIG. 1.

DESCRIPTION OF A PREFERRED EMBODIMENT

Figure 6:
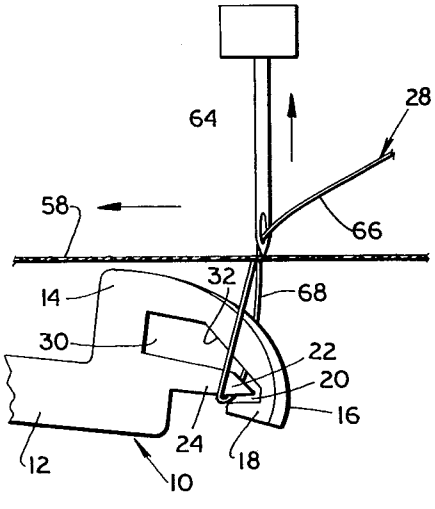
FIGS. 3 thru 9 are a series of diagrammatic side elevation views showing in sequence the formation of high cut loops and low cut loops by the present invention.

By way of background, a conventional-type multi-needle tufting machine (such as disclosed in U.S. Pat. No. 2,875,714 to J. H. Nix or mentioned in U.S. Pat. No. 2,853,034 to A. H. Crawford) comprises a frame with a bedplate adapted to support a substrate which is usually a combination of jute or plastic and other material and into which needles are driven in a side-by-side relationship across the machine to create a straight row by each needle through the constant movement of the substrate in a continuous manner each time the needle makes a reciprocating stroke upwardly and downwardly through the fabric to make one complete loop. The needle drive means includes driven shafts provided with cams and eccentrics operated with various connecting rods to reciprocate the needles simultaneously in one operation through the substrate in a downward direction and upwardly again for each stroke. The yarn feeding is controlled to each needle by means of any conventional and common patterning devices known in the art among which in addition to the Nix U.S. Pat. No. 2,875,714 mentioned above is the Crawford arrangement disclosed in U.S. Pat. No. 2,853,034 and the Card pattern control disclosed in U.S. Pat. No. 2,935,037. Any suitable patterning device may be used with the present method and apparatus so long as it controls, including tensioning, the feed of the yarn to each needle at the proper time and supplies a small increment of yarn at the proper time to make a long loop and supplies a shorter length of yarn at the proper time to make a shorter loop according to the predetermined pattern which is entered into the pattern control device based upon the overall pattern to be made in the completed pile carpet fabric.

Referring initially to the perspective view in FIG. 1, the looper element in its present form is machined from a flat piece of tool steel plate and the completed device is designated generally by reference numeral 10 and comprises an attaching bar portion 12 shaped in a rectangular formation which has a curved projecting forward portion designated generally by reference numeral 14 comprising an end having a front edge shaped like a nose portion 16 having an inwardly turned bottom member 18 defining a hook 19 which has an angled cavity 20 in which projects the angled end 22 of a bottom projecting finger member 24 leaving a small gap or clearance (e.g. 0.020 to 0.040 inch) so that yarn 28 may be pulled through the gap by tensioning same causing the loop to ride up on the backside of the nose 16 in a space 30 defined by the end 16, the projecting member 24 and the backside 32 of nose 16. The top edge 33 of forward portion 14 is inclined to a thin edge.

Figure 5:
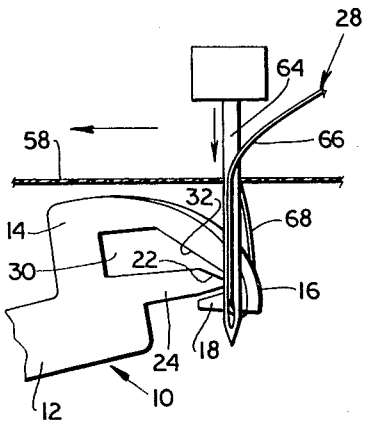
Figure 4:
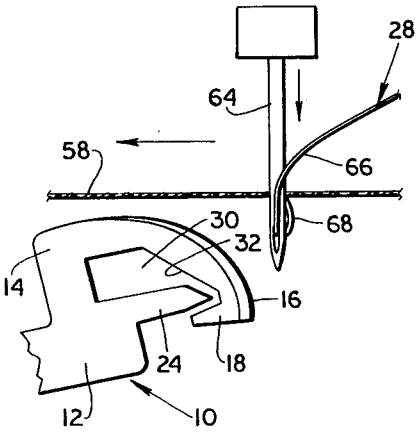
Figure 3:
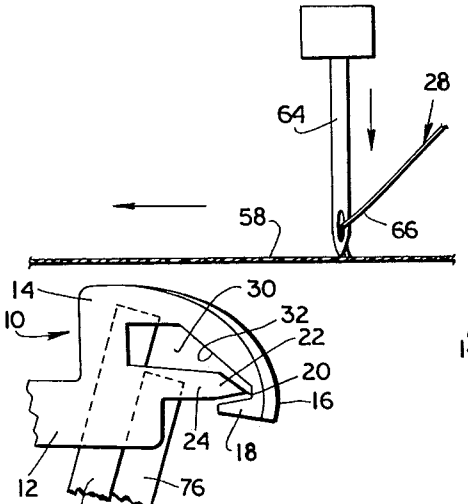
Figure 10:
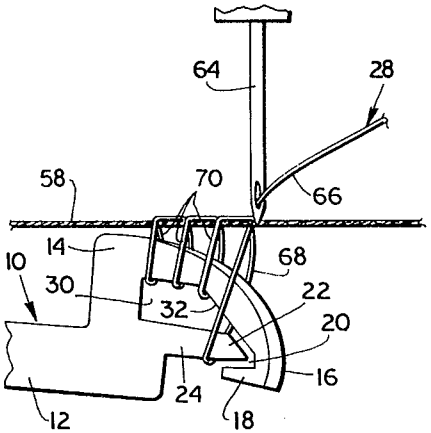
FIG. 10 is a diagrammatic side elevation view of the looper similar to those in FIGS. 3 thru 9 and illustrating the storing of several loops prior to cutting.
Figure 9:
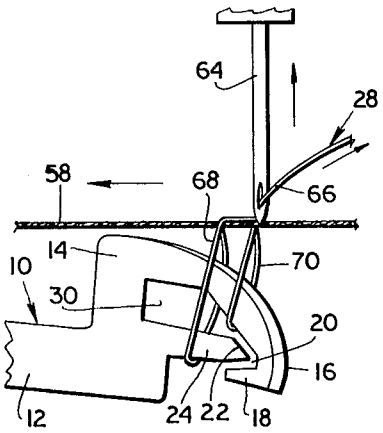
Figure 8:
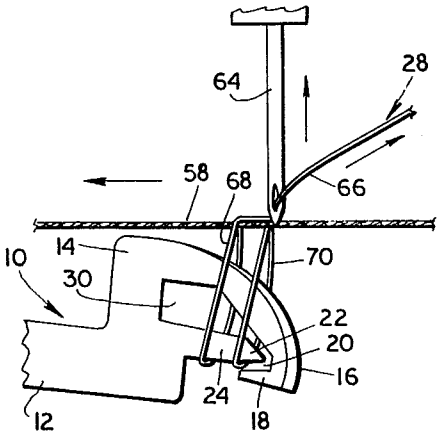
Figure 7:
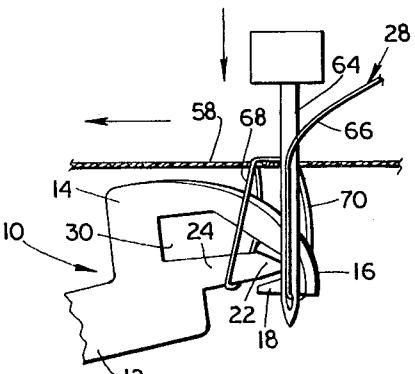

Conventional tufting machine mechanism shown in FIG. 2 includes a hook bar 50 driven by a shaft 52 to reciprocate the individual hook elements 10 into and out of the loops 68 which are formed through the backing material 58 which travels on the backing plate 60 having a needle plate 62 thereover into which the needles 64 penetrate the backing material 58 carrying the continuous yarn 66 from the pattern control device (not shown). The needle 64 shown in FIGS. 2 thru 9 penetrates the backing 58 and vertically reciprocates in one direction to its lowermost position in FIG. 5 before the looper 10 starts to enter the loop 68 which has been formed on one side of the backing 58. The nose 16 of the looper enters the loop 68 and in FIG. 5 the pattern control device has delivered a long loop for a high cut pile which means that the high loop 68 will be stored on the member 24 in the manner shown in FIG. 6 as the fabric moves in the direction opposite to the movement of the looper 10 and thereafter the looper reverses the direction shown in FIG. 7 and travels back to the initial position out of the loop 68 and thence begins the next cycle shown in FIG. 7 wherein the next time the needle 64 is only supplied with a shorter length of material by the pattern control device (which means of course in the tufting art that the slack is taken out by means of the pattern control and related mechanism including the yarn tensioning means to take the slack out to make only a short loop which is pulled as the looper element 10 returns from its forward travel to its rearward travel) and therefore the yarn is tensioned back from the pattern control device and the needle brings it down to the full length shown in FIG. 8 wherein when the looper element returns from its forward travel to its rearward travel the slack is taken out of yarn 28 by the upward movement of the needle 64 and short loop 70 is pulled in the gap or notch between the end of member 22 and the inside inclined face 20 of the back of the nose 16 and the movement of the fabric will move the loop up into the space 30 and around the curved portion of the top of the nose 14 storing the short loops on the forward portion 14 and so on sewing the long loops on the member 24 and the short loops on the upper portion of forward portion 14 until such time as the camming of the operation of the knifebar 72 causes the knifebar to reciprocate into contact with the loops 68 and 70 stored on the looper element 10. There is a long knife 74 and a short knife 76 mounted in a bracket 78 on the knifebar 72 which is mounted on a reciprocating support 80 on a frame member 82 and driven by a shaft 84 from a camming and eccentric arrangement which is common and conventional to such tufted textile machines and is not shown herein. According to this invention it is not necessary and the yarn 66 is not backdrawn during formation of a loop from a previous loop (the procedure for "backdrawing" referred to herein means borrowing or robbing from the previously formed loop so as to make that loop shorter and thereby make the previous loop a short loop rather than the particular loop being formed. Thus, the formation of short loops in the present method does not and does not have to backdraw to any significant or meaningful extent from a previously formed loop and therefore the previous loop is not made a short loop by backdrawing.) through the fabric backing 58 and the mere tensioning of the yarn and removal of the slack by the needle and the holding of the yarn 66 by the pattern control device and the relaxing of the yarn 66 is sufficient to feed the short loops into the space 30 without backdrawing the yarn or robbing from a previous loop. Thus, the long loops 68 are formed and stored on the looper member 24 while the short loops are formed, pulled and stored inside the opening 30 around the top part of the nose 14. Thus, a short loop is initially dropped onto the member 24 and then is moved into the slot 20 only upon the rearward travel of the looper element 10 thereby assuring that only short loops go into the slot.

While I have shown and described a particular embodiment of this invention this is by way of illustration since various alterations, changes, deviations, eliminations, substitutions and departures may be made in the embodiment shown and described without departing from the scope of this invention as defined in the appended claims.

What is claimed:

1. In a tufting machine: means for feeding a base fabric in one direction, a needle for carrying yarn to penetrate the base fabric and form long and short loops therein, means for reciprocating the needle thru the base fabric, means for feeding yarn to said needle and means for controlling said yarn including tensioning or drawing thereof to form longer and shorter yarn loops, a looper element mounted on said machine having an end facing in the direction opposite to the direction of the fabric feed for reciprocation to enter a succession of long and short loops and said end comprising an upper forwardly extending portion terminating in an inwardly turned bottom member, a bottom projecting finger defining with said bottom member an entrance for short loops along the bottom of the looper, there being a space between the bottom member and said projecting finger for short yarn loops to pass through into said space when the looper moves rearwardly with respect to the fabric in the same direction as the direction of movement of the feeding of the fabric, said entrance permitting the passage into the space of a short loop through the entrance when sufficient tension is exerted upon the loop, and means for reciprocating said looper element.

2. The device in claim 1 wherein said portion of said bottom member and said projecting finger are coextensive.

3. The looper element in claim 1 wherein: the bottom projecting finger is coextensive with part of said inwardly turned bottom member, and said bottom member is beneath and spaced from said projecting finger.

4. The looper element in claim 2 wherein said inwardly turned bottom member is beneath and below said bottom projecting finger.

5. The looper element in claim 1 wherein said bottom projecting finger has a pointed terminal end having a slanted bottom and a slanted top.

6. The looper element in claim 5 wherein said pointed terminal end projects into an angled cavity behind said looper end.

7. The looper element in claim 3 wherein said inwardly turned bottom member is beneath and below said bottom projecting finger.

8. The device in claim 1: a knife means comprising a high loop cutting edge and a low loop cutting edge both in substantially the same plane for cooperating with said looper element to sever respective high and low loops thereon when said looper element has been moved away from said needle in the direction of fabric feed and means for moving said knife means to cut said loops.

9. A looper element for use in tufting machines, said looper element comprising a mounting portion for mounting the same on a tufting machine, to enter the loops in succession and having an end facing in the direction opposite to the direction of the fabric feed for reciprocation to enter a succession of long and short loops, said end comprising an upper forwardly extending portion terminating in an inwardly turned bottom member, a bottom projecting finger defining with said bottom member an entrance for short loops along the bottom of the looper, there being a space between the bottom member and said projecting finger for short yarn loops to pass through into said space when the looper moves rearwardly with respect to the fabric in the same direction as the direction of movement of the feeding of the fabric thereby moving the loops upon the looper element away from said entrance whereby the feeding of the fabric moves the loops upon the looper element away from the entrance, said entrance permitting the passage into the space of the short loop through the entrance when sufficient tension is exerted upon the loop.

10. The device in claim 9 wherein said end of said looper curves smoothly toward said bottom member forming a point therewith.

11. The device in claim 9 wherein said bottom member and said projecting finger are coextensive and said bottom member is below and offset from said projecting finger.

12. The looper element in claim 9 wherein the bottom projecting finger is coextensive with part of said inwardly turned bottom member, and said bottom member is beneath and spaced from said projecting finger.

13. The looper element in claim 9 wherein said bottom projecting finger has a pointed terminal end having a slanted bottom and a slanted top.

14. The looper element in claim 13 wherein said pointed terminal end projects into an angled cavity behind said looper end.

15. The looper element in claim 9 wherein said inwardly turned bottom member is beneath and below said bottom projecting finger.

16. The looper element in claim 9 said passage being angled to extend away from said mounting portion and thence toward same.

17. The device claimed in claim 9 in which said end is a pointed nose and the lower portion of said nose extends into said bottom member to define therewith the passage for short loops wherein said loops enter said passage when said short looper element reciprocates in the direction of fabric feed.

18. In a tufting machine: means for feeding a base fabric in one direction, a needle for carrying yarn to penetrate the base fabric and form long and short loops therein, means for reciprocating the needle thru the base fabric, means for feeding yarn to said needle and means for controlling said yarn including tensioning or drawing thereof to form longer and shorter yarn loops, a looper element mounted on said machine having an end facing in the direction opposite to the direction of the fabric feed for reciprocation to enter a succession of long and short loops and said end comprising an upper forwardly extending portion terminating in an inwardly turned bottom member, a bottom projecting finger cooperating with said bottom member to define an entrance for short loops along the bottom of the looper, there being a space between the bottom member and said projecting finger for short yarn loops to pass through into said space when the looper moves rearwardly with respect to the fabric in the same direction as the direction of movement of the feeding of the fabric thereby moving the loops upon the looper element away from said entrance, said entrance permitting the passage into the space of a short loop through the entrance when sufficient tension is exerted upon the loop, means for reciprocating said looper element, a knife means comprising a high loop cutting edge and a low loop cutting edge both in substantially the same plane for cooperating with said looper element to sever respective high and low loops thereon when said looper element has been moved away from said needle in the direction of fabric fed and means for moving said knife means to cut said loops.

19. A method of tufting high cut pile and low cut pile in the same row of stitching comprising supporting a base fabric and feeding same in one direction, stitching a yarn to form a row of successive yarn loops on one side of said fabric, supporting upon said one side of said fabric a looper element having a closed free end, relatively moving the looper element so that its closed, free end enters the loops in succession, providing an opening forming a short loop yarn passage on the bottom of said looper element, defining on said free end an upper forwardly extending portion terminating in an inwardly turned bottom member, providing a bottom projecting finger member on said looper which terminates at the short loop yarn passage onto which both long and short loops are moved, defining the direction of said passage for said short loops in a forwardly direction and thence in a rearwardly direction by the bottom projecting finger member and the inwardly turned bottom member, moving the looper element rearwardly with respect to the fabric in the same direction as the direction of movement of the feeding of the fabric, and tensioning said short loop yarn to pull said short loop thru said yarn passage while moving the looper in said rearwardly direction with the movement of the fabric, and feeding said fabric to cause relative movement between the looper and fabric causing said short loops to move thru said passage.

20. The method in claim 19 including directing the short loops entering the passage to loop about said upper forwardly extending portion for subsequent cutting thereon.

21. A method tufting high cut pile and low cut pile in the same row of stitching comprising supporting and feeding a base fabric in one direction, stitching a yarn continuously through said base fabric as said fabric moves to form a row of successive yarn loops on one side of said fabric, supporting upon one side of said fabric a reciprocatory looper element having a free end pointing in the direction opposite the fabric feed so that said closed free end enters both the long and short loops as supplied and controlled, moving the looper element in a direction opposite the fabric feed into a loop, providing an opening forming a short loop yarn passage on the bottom of said looper element, said yarn passage being defined in part by a bottom portion of the end of the looper and another bottom part of said looper located on the other side of the passage in spaced relation with respect to said bottom portion of said end, defining the direction of said passage for said short loops in a forwardly direction toward the looper end between said bottom portion and the other bottom part and thence in a rearwardly direction around the end of the other bottom part, moving the looper element rearwardly with respect to the fabric in the same direction as the direction of movement of the feeding of the fabric, tensioning said short loop yarn to pull said short loop through said passage while moving the looper in said rearwardly direction, moving said long loops past said passage, said short loops entering said passage, causing said long loops to move onto the other bottom part of the looper, and cutting said long loops and said short loops to form high cut pile and low cut pile.

22. A fabric made in accordance with and following the method defined in claim 19 comprising a pile having both a high pile comprising pile members cut from the same loop and low pile comprising pile members cut from the same loop in the same row as said high cut pile pursuant to the method set forth in said claim.

23. A fabric made in accordance with and following the method defined in claim 21 comprising a pile having both a high pile comprising pile members cut from the same loop and low pile comprising pile members cut from the same loop in the same row as said high cut pile and pursuant to the method set forth in said claim.

24. In a tufting machine:

means for feeding a base fabric in one direction, a needle for carrying yarn to penetrate the base fabric and form loops therein, means for reciprocating the needle thru the base fabric, means for feeding yarn to said needle to form longer and shorter yarn loops, a looper element mounted on said machine to reciprocate thereon and enter into the loops in succession and said looper having an end portion facing in the direction opposite to the direction of the fabric feed, said end portion comprising a top member having an inwardly turned bottom member extending rearwardly therefrom, a bottom lower projecting finger member together with said bottom member defining a space therebetween, said projecting finger member and said inwardly turned bottom member cooperating to form an entrance therebetween for short yarn loops to pass through said entrance into said space and onto said top member when the looper moves rearwardly with respect to the fabric prior to cutting, the feeding of the fabric moving the loops upon the looper element away from said entrance after entry of said looper element into the loops and after selected short yarn loops have entered through said entrance into said space, said entrance being defined by the end of said bottom member extending over said lower finger member whereby yarn entering said entrance must travel forwardly while said looper element moves rearwardly, a portion of the end of said finger member further defining said entrance to said space above said finger member in the direction rearwardly of said looper whereby yarn having entered in a forwardly direction must reverse direction after entering said entrance in order to enter said space whereby a short loop is pulled through the entrance when said yarn is drawn, a means for reciprocating said looper element, a knife means for cooperating with said looper element to sever loops thereon when said looper element has been moved away from said needle in the direction of fabric feed, and means for moving said knife means to cut said loops.

25. The device in claim 24 wherein there is a cutting edge on said knife means for long loops and a cutting edge for short loops, said cutting edges being substantially in the same plane whereby said knife edges may travel in the same plane against the looper thereby reducing the space between loopers.

* * * * *